US008061366B2

(12) United States Patent
Britton et al.

(10) Patent No.: US 8,061,366 B2
(45) Date of Patent: Nov. 22, 2011

(54) COVER FOR PONYTAILS

(76) Inventors: Nona J. Britton, Eagle, ID (US); Lauren E. Britton, Eagle, ID (US)

( * ) Notice: Subject to any disclaimer, the term of this patent is extended or adjusted under 35 U.S.C. 154(b) by 316 days.

(21) Appl. No.: 12/430,689

(22) Filed: Apr. 27, 2009

(65) Prior Publication Data

US 2010/0108088 A1 May 6, 2010

Related U.S. Application Data

(60) Provisional application No. 61/048,069, filed on Apr. 25, 2008.

(51) Int. Cl.

| | |
|---|---|
| ***A45D 7/00*** | (2006.01) |
| ***A45D 8/00*** | (2006.01) |
| ***B68B 1/00*** | (2006.01) |
| ***A41F 1/00*** | (2006.01) |
| ***A44B 1/04*** | (2006.01) |
| ***A44B 11/25*** | (2006.01) |
| ***A44B 17/00*** | (2006.01) |
| ***B42F 1/00*** | (2006.01) |
| ***B65D 33/16*** | (2006.01) |
| ***B65D 33/28*** | (2006.01) |

(52) U.S. Cl. ..... 132/200; 132/273; 54/78; 24/484; 383/66; 383/74; 383/75

(58) Field of Classification Search ..... 132/200, 132/207, 59–61, 212, 273–276; 2/207, DIG. 11; D28/39–43; 119/600, 601, 607, 811, 850; 224/251, 603; 383/71, 72, 74, 75, 66; 54/78; 24/484, 115 H, 712.1, 129 R, 129 D
See application file for complete search history.

(56) References Cited

U.S. PATENT DOCUMENTS

| | | | | | |
|---|---|---|---|---|---|
| 2,211,184 | A | * | 8/1940 | Varell | 2/174 |
| 2,500,257 | A | * | 3/1950 | Mahan | 224/250 |
| 2,579,089 | A | * | 12/1951 | Price | 132/274 |
| 3,099,271 | A | * | 7/1963 | Dubelier | 132/273 |
| 3,268,913 | A | * | 8/1966 | Gettinger | 2/171 |
| D205,829 | S | * | 9/1966 | Gettinger | D2/880 |
| 4,173,042 | A | * | 11/1979 | Krzewinski-Morris | 2/174 |
| 5,062,256 | A | | 11/1991 | Kingett et al. | |
| 5,086,612 | A | * | 2/1992 | Anderson | 54/78 |
| 5,099,865 | A | * | 3/1992 | Flannery et al. | 132/212 |
| 5,465,741 | A | | 11/1995 | Dvorak | |
| 5,472,003 | A | | 12/1995 | Frame et al. | |
| 5,555,901 | A | | 9/1996 | Camp, Jr. et al. | |

(Continued)

OTHER PUBLICATIONS

Satin Sleep Cap. http://www.harrietcarter.com/index.cfm/fuseaction/product.detail/categoryID/5C3A0EC3-65C7-48E1-8700-A808611E8399/productID/B6AC4A81-9999-4B82-8924-F702A0017C09.

(Continued)

*Primary Examiner* — Todd Manahan
*Assistant Examiner* — Vanitha Elgart
(74) *Attorney, Agent, or Firm* — Robert L. Shaver

(57) ABSTRACT

Presented is a hair restraint which is placed on a user's ponytail to assist in keeping the ponytail tangle free during sleep. The device includes a drawstring, a drawstring lock, and may be utilized with a headband which gathers the hair and holds it into a ponytail while the device is attached. The ponytail can be formed in the back of the users head or more towards the top of the user's head to provide less of an obstruction while the user is sleeping.

5 Claims, 4 Drawing Sheets

U.S. PATENT DOCUMENTS

| | | | | |
|---|---|---|---|---|
| 5,566,689 | A * | 10/1996 | Yeater | 132/212 |
| 5,595,199 | A | 1/1997 | Solomon et al. | |
| 5,694,750 | A | 12/1997 | Allen | |
| 5,727,575 | A | 3/1998 | Rontal | |
| 5,730,161 | A | 3/1998 | Kohanek | |
| 5,778,904 | A * | 7/1998 | Elsner | 132/275 |
| 5,878,756 | A | 3/1999 | Bilodeau | |
| 5,950,636 | A * | 9/1999 | Hickey | 132/200 |
| 5,970,991 | A | 10/1999 | Srivastava | |
| 6,085,695 | A * | 7/2000 | Miller et al. | 119/795 |
| 6,182,672 | B1 * | 2/2001 | Abasta-Douglas et al. | 132/275 |
| 6,260,555 | B1 * | 7/2001 | Natvig | 132/200 |
| 6,425,405 | B1 | 7/2002 | McRoberts | |
| 6,622,310 | B1 | 9/2003 | Tsai | |
| 6,735,783 | B2 | 5/2004 | Phillips | |
| D509,320 | S * | 9/2005 | Shefsky et al. | D28/41 |
| D509,625 | S | 9/2005 | Pena | |
| 7,174,901 | B2 * | 2/2007 | Haar et al. | 132/273 |
| 7,921,470 | B2 * | 4/2011 | Doran | 2/59 |
| 2002/0056467 | A1 * | 5/2002 | Srivastava | 132/273 |
| 2003/0029470 | A1 * | 2/2003 | Srivastava | 132/274 |
| 2005/0188925 | A1 * | 9/2005 | Yun et al. | 119/850 |
| 2007/0246059 | A1 * | 10/2007 | Jensen | 132/273 |
| 2009/0151048 | A1 * | 6/2009 | Laury | 2/202 |
| 2010/0242980 | A1 * | 9/2010 | D'Assis et al. | 132/200 |

OTHER PUBLICATIONS

Knotty Soc. http://www.dreadhairstyles.com/D-Knotty%20Soc%20Page.htm.

Silver ponytail holder. http://www.bairsindiantradingco.com/jewelry_items/88-AB-11,12,13_2.htm.

* cited by examiner

COVER FOR PONYTAILS

This application claims the priority date of the provisional application entitled FABRIC HAIR SLEEVE filed by Nona J. Britton and Lauren E. Britton on Apr. 25, 2008 with application Ser. No. 61/048,069, the disclosure of which is incorporated by reference.

FIELD OF THE INVENTION

The invention generally relates to a device for restraining hair, and more particularly to a hair restraint for use on human hair bundled into a ponytail.

BACKGROUND OF THE INVENTION

It is common for people with long hair to spend a considerable amount of time brushing the hair in order to get the tangles out of the hair, and to make the hair attractive and tangle free. The longer a person's hair, the more time this process can take. A problem occurs when a person with long hair goes to bed for the night. The person may have spent a considerable amount of time brushing their hair and they may have put it into a ponytail to minimize the tangling, but merely putting it in a ponytail does not prevent tangling which occurs as the person tosses and turns all night.

To the persons that this may affect, they awake with a head full of tangles in their hair, and must brush their hair out in the morning in order to remove the tangles.

What is needed is a device, and a method for using the device which can be placed over a user's ponytail, and which can be slept on and prevent the hair from tangling during a night of sleep.

SUMMARY OF THE INVENTION

The invention is a hair restraint device for use in restraining human hair which is bundled together and held by a hair band adjacent to a user's head. The hair band which holds the bundle of hair together can be of many configurations including an elasticized band which is looped over the hair bundle a number of times, or an elasticized band which includes an attached ball, or various other clips, clamps, bands, and loops.

The hair restraint device of the invention includes a tubular body made of a soft material. The material itself can be a soft fabric, a stretch fabric, cotton, nylon, rayon, silk, polyester or a polyester blend, or any other type of soft fabric which is comfortable for the user. The tubular body is sized for different sized users and their hair. Some typical sizes of the tubular body would be generally described as short, medium and long, with the short being approximately 8 inches in length, and the long being approximately 18 inches in length. The diameter of the tubular body of the restraining device also varies with a small diameter hair restraint being approximately 6 inches in diameter, and a large diameter hair restraint being approximately 8 inches in diameter. A user would purchase the size which is appropriate for the user's hair when formed into a bundle such as a ponytail.

The tubular body of the invention has a first end and a second end, with the first end containing a drawstring sleeve. A drawstring is located in the drawstring sleeve, and is available to the user for tightening around the bundle of hair, for closing off the tubular body at the first end and cinching it down tight on the ponytail of the user.

The device includes a drawstring lock on the drawstring with the drawstring lock configured to tighten on the drawstring and secure the first end of the tubular body in a cinched position around a bundle of hair.

The tubular body can include a slit which is at the first end of the tubular body with the slit running parallel to the long axis of the tubular body. This slit provides additional space for the user in manipulating the ponytail and pulling it inside the tubular body. This slit would vary according to the size of the user's ponytail and could be from two to four inches in length.

The hair restraint preferably includes a cord passage which can be a hole in the drawstring sleeve which allows the passage of the drawstrings ends out of the drawstring sleeve. This cord can be in the general form of a button hole, or can be a hole with a hard or soft grommet or stitching around the size of the hole. The cord passage would generally be positioned on the opposite side of the drawstring sleeve opposite the slit in the tubular body.

The invention also is a method of securing hair using a device as described above. The method includes the step of gathering hair on a user's head to form a ponytail or bundle of hair. The next step is securing the ponytail with a hair band, which wraps around the ponytail and secures the ponytail in a tight encircling closure, which can also be described as a circumvolving closure. The next step is inserting the pony tail into a tubular body, with the tubular body made of a soft material, the tubular body having a first end and a second end, and with the tubular body having a drawstring sleeve located on the first end and a drawstring located in the drawstring sleeve. The drawstring is configured to tighten and close off the tubular body around the ponytail at the first end of the tubular body. A drawstring lock is included and the drawstring lock is configured to clamp on the drawstring and to secure the first end of the tubular body in cinched position around the bundle of hair or ponytail. Another step of this method can be tightening the drawstring at a location between the hair band and the user's head. The tubular body described above can function without interacting with a hair band, but a hair band provides a slightly more secure attachment.

The tubular body used with the method above can further include a slit of approximately two to four inches in length which is parallel with longitudinal axis of the tubular body and at the first end of the tubular body. This provides additional space for the user's fingers to extend through the tubular body to grip a ponytail and pull it through the tubular body. The method of the invention can include inserting the ponytail into the tubular body by manually compacting the tubular body into a ring, and then inserting a user's index finger and thumb into the ring to grab the ponytail with the user's fingers, and then pulling the ponytail through the ring and then unfolding and extending the tubular body from the ring shape to a fully elongated shape, with the ponytail enclosed within the tubular body.

The purpose of the Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other features and advantages of the claimed invention will become readily apparent to those skilled in this art from the following detailed description describing preferred embodiments of the invention, simply by way of illustration of the best mode contemplated by carrying out my invention. As will be realized, the invention is capable of modification in various obvious respects all without departing from the invention. Accordingly, the drawings and description of the preferred embodiments are to be regarded as illustrative in nature, and not as restrictive in nature.

DESCRIPTION OF THE PREFERRED EMBODIMENTS

Figure 1:
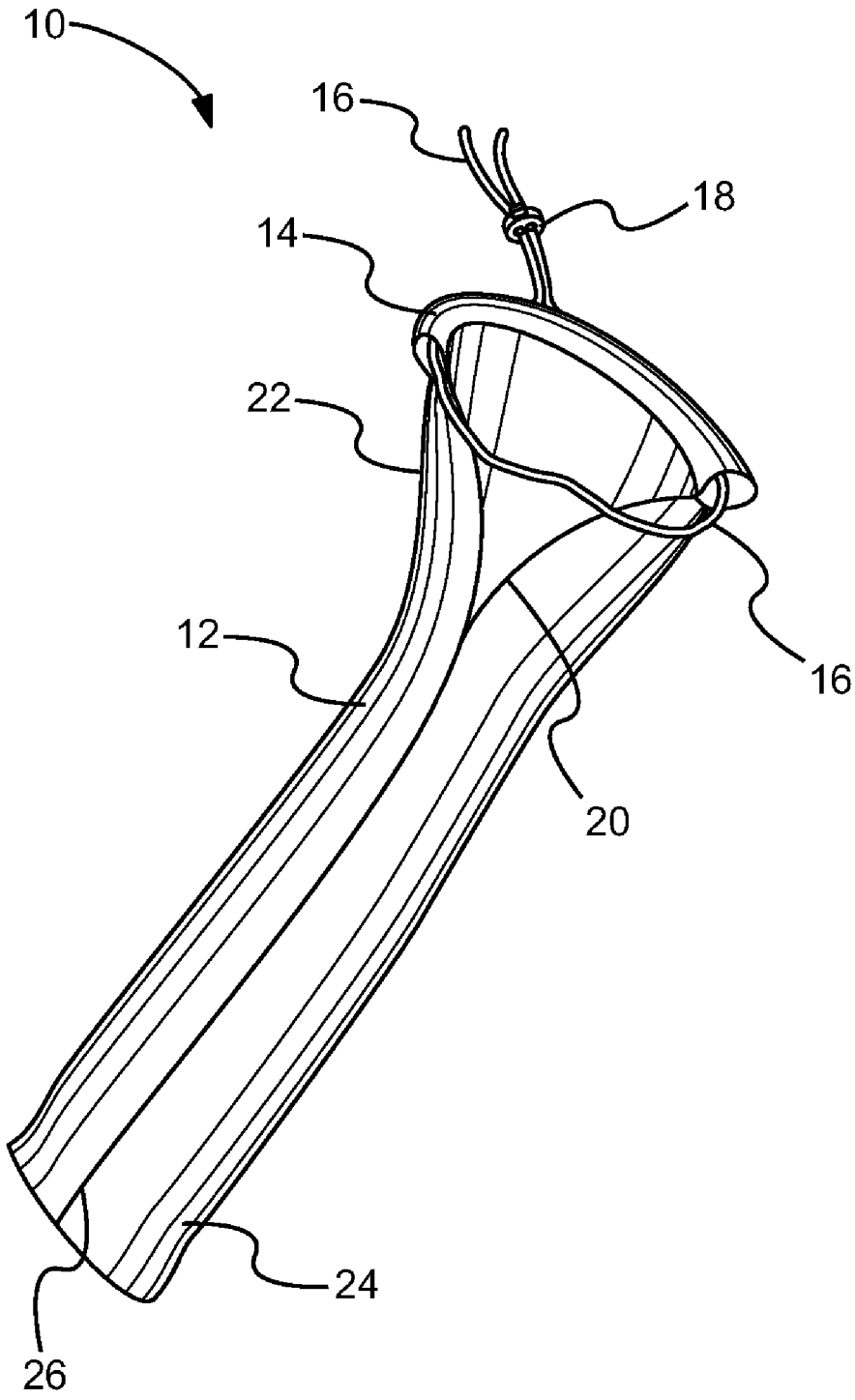
FIG. 1 is a perspective view of the device of the invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

In the following description and in the figures, like elements are identified with like reference numerals. The use of "e.g.," "etc," and "or" indicates non-exclusive alternatives without limitation unless otherwise noted. The use of "including" means "including, but not limited to," unless otherwise noted.

The device of the invention and the method of the invention are shown to advantage in FIGS. 1-9. FIG. 1 shows the hair restraint 10 with a tubular body 12, a drawstring sleeve 14 a drawstring 16 a first end of the tubular body 22 and a second end of the tubular body 24.

Also shown is a drawstring lock 18, a slit 20 in the tubular body and a seam 26 running longitudinally in the tubular body.

The drawstring lock 18 is of a type which can slide up and down on the drawstring 16 and when released locks in place on the drawstring. Thus when the drawstring 16 is pulled through the drawstring lock 18, the drawstring 16 will tighten around whatever is enclosed within the drawstring.

The tubular body of the invention is preferably made of a soft material such as cotton, but other fabrics can also be utilized such as nylon, polyester, polar fleece, silk, rayon, and many other fabrics. The synthetic fabrics such as nylon, polyester and polar fleece have the advantage of drying quickly and drawing moisture from the hair if placed over wet hair. The drawstring can be made of cotton, nylon, polyester or other common drawstring materials and is approximately 1/16 to 1/4 of an inch in diameter and approximately 18 inches long, depending on the width size of the device. The drawstring lock can be of a number of different types, but it is advantageous to have it as small in bulk as possible. A drawstring lock purchased from Norman Shatz Company, with the catalog designation #533 frost mini drum lock has proven to be satisfactory for this purpose.

Figure 2:
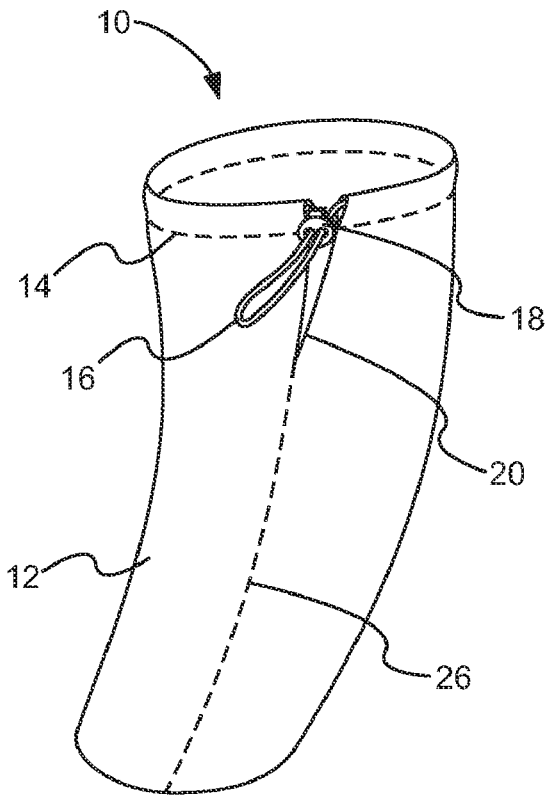
FIG. 2 is a perspective of another version of the invention.
Figure 3:
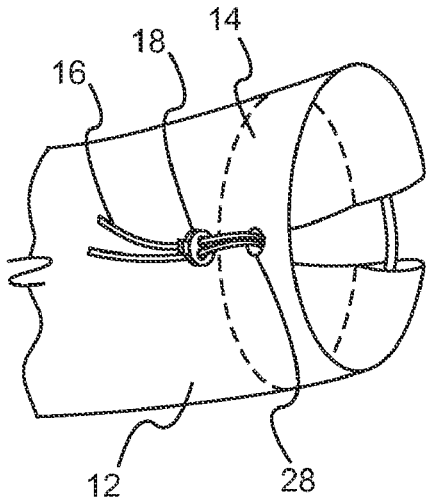
FIG. 3 is a perspective view showing a close up of part of the invention.

FIG. 2 is another preferred embodiment of the invention, and in this version the drawstring 16 exits the drawstring sleeve through the region of the slit 20. In the version shown in FIG. 1, the drawstring exits the drawstring sleeve through a small hole in the drawstring sleeve, which would be similar to a button hole or could be reinforced with a grommet. FIG. 3 shows additional detail of a preferred embodiment shown in FIG. 1, which includes a view of where the drawstring 16 exits the drawstring sleeve 14 through a drawstring passage 28.

Figure 4:
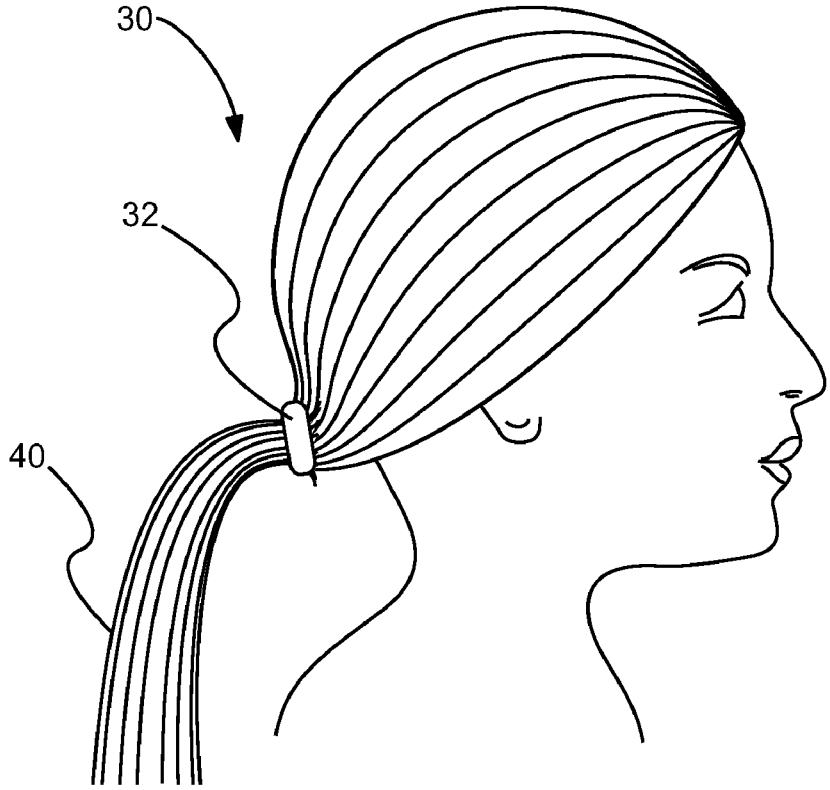
FIG. 4 shows one step in the use of the invention.

FIG. 4 shows a step 30 in the method of applying the device of the invention to the user's head. In this step the user's hair is bundled into a ponytail and secured with a headband 32.

Figure 5:
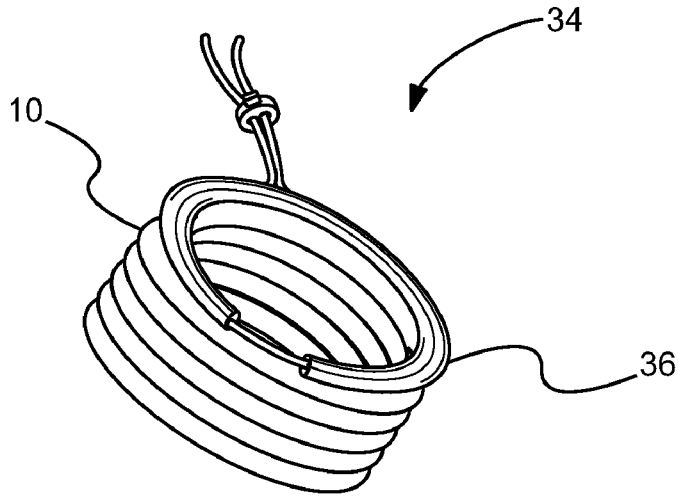
FIG. 5 is a perspective view which shows another step in the use of the invention.

FIG. 5 shows the step 34 of compressing the device 10 into a compact ring 36.

Figure 6:
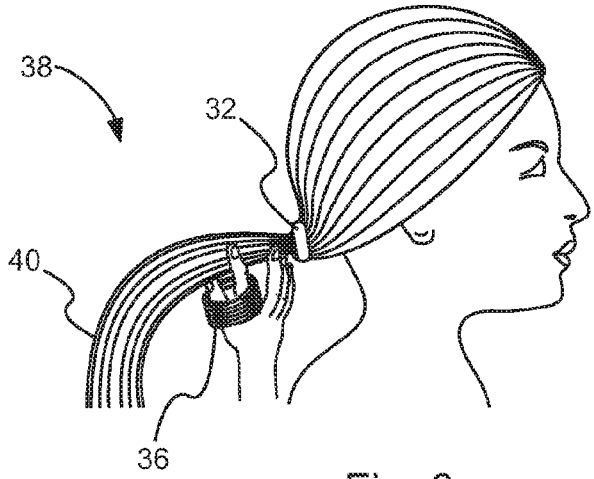
FIG. 6 shows a step in the method of using the invention.

FIG. 6 shows the step 38 of pulling the ponytail through the compact ring 36 in order to position the compact ring 36 on the ponytail.

Figure 7:
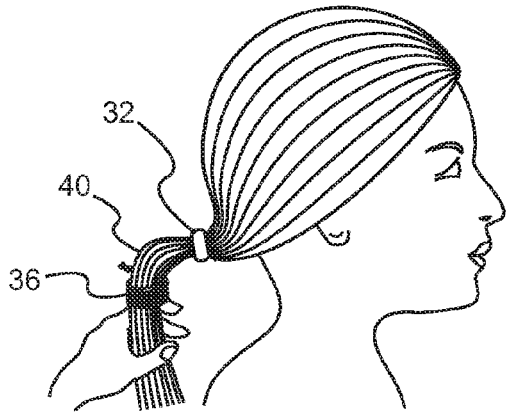
FIG. 7 shows a step in the method of using the invention.

FIG. 7 shows the compact ring 36 on a user's ponytail 40.

Figure 8:
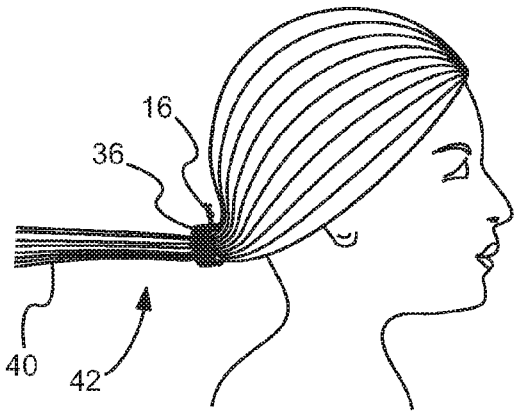
FIG. 8 shows a step in the method of using the invention.

FIG. 8 shows the step 42 of positioning the compact ring 36 over the headband 32. After the compact ring 36 is positioned over the headband the drawstring 16 can be tightened, and the drawstring lock 18 can secure the hair restraint 10 on the ponytail 40. By securing it between the headband 32 and the user's head, additional security is provided for securing the hair restraint 10.

Figure 9:
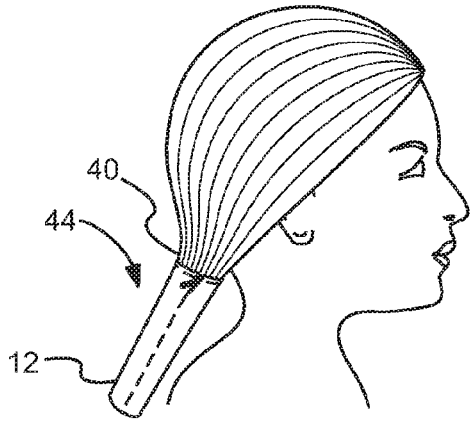
FIG. 9 shows a step in the method of using the invention.

FIG. 9 shows step 44 in which the device is extended from a compact ring form into the fully extended version, with the tubular body 12 covering the hair of the ponytail 40. In this configuration the user may sleep on the ponytail 40 and the hair will remain free of tangles for the next morning. Alternatively, the ponytail can be formed closer to the top of the users head so that the ponytail, headband, and hair restraint of the invention have less interaction with the pillow and bed of the user as he or she sleeps.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

What is claimed is:

1. A hair restraint device for use in restraining human hair which is bundled together and held by a hair band adjacent to a users head, said device comprising:

a tubular body of a soft material, suitable to enclose a generally cylindrical space equivalent in size to a bundle of human hair, said tubular body having an open end first end and an open end second end, and comprising a slit 3-4 inches in length in said first end of said tubular body, with said slit running parallel to the long axis of the tubular body;

a drawstring sleeve positioned on said first end of said tubular body, and a drawstring located in said drawstring sleeve, configured to tighten and close off said tubular body at said first end, said drawstring sleeve comprising a cord passage in said drawstring sleeve for passage of drawstring ends out of said sleeve, with said cord passage positioned opposite said slit; and a drawstring lock on said drawstring, with said drawstring lock configured to tighten on said drawstring and to secure said first end of said tubular body in a cinched position around said bundle of hair.

2. A method of securing human hair for reduced tangling during sleep, the method comprising:

gathering hair on a user's head to form a pony tail;

securing said pony tail with a hair band which wraps around said pony tail and secures said ponytail in a tight circumvolving closure;

inserting said pony tail into a tubular body of soft material, with said tubular body having an open end first end and an open end second end, and with said tubular body having a drawstring sleeve positioned on said first end of said tubular body, and a drawstring located in said drawstring sleeve, and with said tubular body comprising a slit opposite a drawstring exit point from said drawstring sleeve, with said drawstring configured to tighten and close off said tubular body at said first end, said tubular body further comprising a drawstring lock on said drawstring, with said drawstring lock configured to tighten on said drawstring and to secure said first end of said tubular body in a cinched position around said bundle of hair; and tightening said drawstring lock around said pony tail.

3. The method of claim 2 which further comprises the step of tightening said drawstring on said ponytail in a location between said hair band and said user's head, with said hair band positioned to prevent slipping of said tubular body from said pony tail by blocking said cinched first end from slipping down said pony tail.

4. The method of securing human hair of claim 3 which further includes the step of inserting said pony tail into said tubular body by manually compacting said tubular body into a ring, inserting a user's fingers into said ring, hooking said pony tail with a user's fingers inserted into said ring, pulling said pony tail through said ring, and extending said tubular body from said ring shape to a fully elongated shape, with said pony tail enclosed within said tubular body.

5. A method of securing human hair for reduced tangling during sleep, the method comprising:

gathering hair on a user's head to form a pony tail;

securing said pony tail with a hair band which wraps around said pony tail and secures said ponytail in a tight circumvolving closure;

inserting said pony tail into a tubular body of soft material, with said tubular body having an open end first end and an open end second end, and with said tubular body having a drawstring sleeve positioned on said first end of said tubular body, and a drawstring located in said drawstring sleeve with said tubular body comprising a slit opposite a drawstring exit point from said drawstring sleeve, with said drawstring configured to tighten and close off said tubular body at said first end, said tubular body comprising a drawstring lock on said drawstring, with said drawstring lock configured to tighten on said drawstring and to secure said first end of said tubular body in a cinched position around said bundle of hair in a location between said hair band and said user's head;

inserting said pony tail into said tubular body by manually compacting said tubular body into a ring, inserting a user's fingers into said ring, hooking said pony tail with a user's fingers inserted into said ring, pulling said pony tail through said ring, and extending said tubular body from said ring shape to a fully elongated shape, with said pony tail enclosed within said tubular body; and tightening said drawstring around said pony tail at a position between said hair band and said user's head, with said hair band positioned to prevent slipping of said tubular body from said pony tail by blocking said cinched first end from slipping down said pony tail.

* * * * *